United States Patent [19]

Izumi et al.

[11] Patent Number: 4,851,673

[45] Date of Patent: Jul. 25, 1989

[54] SECONDARY ION MASS SPECTROMETER

[75] Inventors: Eiichi Izumi, Takahagi; Hiroshi Iwamoto, Katsuta; Eisuke Mitani, Tokorozawa; Hiroyasu Shichi, Koganei, all of Japan

[73] Assignee: Hitachi, Ltd., Tokyo, Japan

[21] Appl. No.: 228,018

[22] Filed: Aug. 4, 1988

[30] Foreign Application Priority Data

Aug. 12, 1987 [JP] Japan ..... 62-201613

[51] Int. Cl.[4] ..... H01V 49/02

[52] U.S. Cl. ..... 250/309; 250/397; 250/283; 250/281; 324/71.3

[58] Field of Search ..... 250/309, 397, 283, 281; 324/71.3

[56] References Cited

U.S. PATENT DOCUMENTS

| | | | |
|---|---|---|---|
| 3,209,143 | 9/1965 | Hickam et al. | 250/281 |
| 3,881,108 | 4/1975 | Kondo et al. | 250/309 |
| 4,036,777 | 7/1977 | Dubois et al. | 250/397 |
| 4,800,273 | 1/1989 | Phillips | 250/309 |

*Primary Examiner*—Jack I. Berman

*Attorney, Agent, or Firm*—Antonelli, Terry & Wands

[57] ABSTRACT

A secondary ion mass spectrometer including primary ion emitting means for generating a primary ion to irradiate a specimen with the primary ion, means for separating secondary ions sputtered from the specimen, in accordance with mass-to-charge ratios, and detection means for detecting a secondary ion current emerging from the secondary ion separating means is disclosed, in which, when the value of the secondary ion current becomes greater than the upper limit of the dynamic range of the detecting means, the secondary ion current is attenuated by an attenuator, and the value of secondary ion current detected by the detection means is divided by the attenuation factor of the attenuator to obtain a corrected value. Thus, the secondary ion mass spectrometer is prevented from producing an erroneous analytical result due to the saturation of the detection means, that is, has a wide dynamic range, in which the amount of secondary ion varies by eight to ten orders of magnitude. Accordingly, the sescondary ion mass spectrometer can quantitatively determine a high-concentration element and a considerably-low-concentration element at the same time, and can determine the concentration distribution of an analytical element in a wide concentration range from a large value to a considerably small value.

6 Claims, 3 Drawing Sheets

SECONDARY ION MASS SPECTROMETER

BACKGROUND OF THE INVENTION

The present invention relates to secondary ion mass spectrometers, and more particularly to a secondary ion mass spectrometer suited to quantitatively determine a plurality of elements which are widely different from each other in concentration value or an element whose content varies in a wide range.

FIG. 4 is a block diagram showing the fundamental construction of a secondary ion mass spectrometer. Referring to FIG. 4, a primary ion emitting unit 1 produces and accelerates a primary ion 2, and focuses the primary ion beam thus obtained to scan a specimen 3 with the primary ion beam. Secondary ions 4 are sputtered from the specimen 3 bombarded with the primary ion beam. The secondary ions 4 thus obtained are separated according to mass-to-charge ratios by a mass spectrometer 5, and only a secondary ion 6 with a desired mass can pass through a detection slit 7 to reach a detection system 8, in which data indicative of the amount of the secondary ion 6 is stored in a memory, and the stored data is processed to be displayed by a display device.

A DC amplification method shown in FIG. 2 and a pulse measuring method shown in FIG. 3 have hitherto been used in secondary ion detection systems. In the DC amplification method, as shown in FIG. 2, a secondary electron multiplier 10 receives the secondary ion 6 with a desired mass through the detection slit 7, to convert the secondary ion 6 into an electron and to subject the electron to electron multiplication. A current 11 delivered from the secondary electron multiplier 10 is detected by a DC amplifier 18. When the resistance value of a feedback resistor 19 is fixed, the amount of secondary ion can be varied by four or five orders of magnitude within the dynamic range of the detection system. By changing th resistance value of the feedback resistor 19, the dynamic range of the detection system can be further enlarged. The resistance value of the feedback resistor 19 can be changed in a range from $10^5\Omega$ to $10^{11}\Omega$. Accordingly, the detection system is able to have a wide dynamic range, within which the amount of secondary ion varies by ten orders of magnitude. However, in a case where the concentration distribution of an analytical element in the direction of thickness of a specimen is determined, as described in a U.S. Pat. No. 3,811,108 and a Japanese patent application Post-Examination Publication No. 53-2,599, a detector is provided with electrical gate means, to remove secondary ions emitted from the side wall of a crater due to sputtering, thereby detecting only secondary ions emitted from the bottom of the crater. In this case, the DC amplifier 18 is required to respond faithfully to variations in the amount of emitted secondary ion among points scanned with a primary ion. Accordingly, even if the resistance value of the feedback resistor 19 is changed as mentioned above, the detection system will have a dynamic range, within which the amount of secondary ion varies only by seven to eight orders of magnitude.

While, in the pulse measuring method, the secondary ion with a desired mass is treated as a pulse. Referring to FIG. 3, one secondary ion impinges on a secondary electron multiplier 10, to be subjected to electron multiplication, and the pulse current 11 thus obtained is amplified by a high-speed pulse amplifier 12. When the height of the pulse current 11 exceeds a predetermined level set in a discriminator 13, a pulse counter circuit 14 counts up this pulse. As mentioned above, in this method, secondary ions are counted up in a time-divisional manner, and hence the maximum number of secondary ions detectable in a unit time (that is, the maximum detectable secondary ion current) is determined by the response time of each of the high-speed pulse amplifier 12, discriminator 13 and pulse counter circuit 14. Accordingly, this detection system will have a dynamic range, within which the amount of secondary ion varies by six to eight orders of magnitude.

As mentioned above, a detection system using one of the DC amplification method and the pulse measuring method will have a dynamic range, within which the amount of secondary ion varies by eight orders of magnitude at most.

Hence, when a specimen is analyzed by a secondary ion mass spectrometer, it is necessary to satisfy the following requirements. (1) The concentration of an analytical element is greater than that of another analytical element by less than eight orders of magnitude. (2) The concentration of an analytical element varies in a specimen by less than eight orders of magnitude.

As to the first requirement (1), it is to be noted that when a low-concentration impurity in a matrix is quantitatively determined together with a matrix element, the concentration of the matrix element is usually greater than that of the impurity by eight or more orders of magnitude, and thus the detection value of the matrix element will reach a saturation value. In order to solve this problem, one of a multiply-charged ion and a complex ion which are smaller in number than a matrix ion, is detected instead of the matrix ion. However, the switchover of the matrix ion to the multiply-charged ion or complex ion is cumbersome.

As to the second requirement (2), it is to be noted that in a case where the concentration distribution of an impurity in a multi-layered film, in which the impurity can be diffused from one of adjacent layers into the other layer, is detected, or in a case where a specimen, in which the concentration of an impurity is changed from a large value to a considerably small value, is analyzed, the concentration of the impurity will vary by eight orders of magnitude or more, and thus it is impossible to determine the concentration distribution of impurity accurately.

As is evident from the above, a conventional secondary ion mass spectrometer has paid no attention to the enlargement of the dynamic range of a detection system, and hence cannot determine a high-concentration element and a considerably-low-concentration element quantitatively at the same time nor determine the concentration distribution of an analytical element whose concentration varies in a wide range from a large value to a considerably small value.

SUMMARY OF THE INVENTION

It is therefore an object of the present invention to provide a secondary ion mass spectrometer which can enlarge the dynamic range of a detection system to make it possible to determine a high-concentration element and a considerably-low-concentration element quantitatively at the same time and to determine the concentration distribution of an analytical element whose concentration varies in a wide range from a large value to a considerably small value.

In order to attain the above object, according to the present invention, there is provided a secondary ion mass spectrometer including primary ion generating means, primary ion emitting means for irradiating a specimen with a primary ion, means for separating secondary ions sputtered from the specimen, in accordance with mass-to-charge ratios, and detection means for detecting a secondary ion emerging from the secondary ion separating means, in synchronism with the operation of the primary ion emitting means, in which secondary ion mass spectrometer the detection means includes an attenuator for attenuating a secondary ion current flowing from the secondary ion separating means, a comparator for checking whether or not the value of secondary ion current detected by the detection means exceeds a predetermined value lying in the dynamic range of the detection means, a driving power circuit for operating the attenuator when it is judged by the comparator that the value of secondary ion current exceeds the predetermined value, and a control unit for driving the value of secondary ion current obtained in a period when the attenuator is operated, by the attenuation factor of the attenuator to obtain a corrected value of secondary ion current.

According to the present invention, the value of secondary ion current detected in a period when the attenuator is operated, is divided by the attenuation factor of the attenuator to obtain a corrected value. That is, the detected value of secondary ion current is put within the dynamic range of the detection means, and moreover the concentration of an analytical element is faithfully reflected in the detected value secondary ion current. In other words, it is prevented that the detected value of the secondary ion current reaches a saturation value and thus the concentration of the analytical element is erroneously displayed. Thus, according to the present invention, a high-concentration element and an considerably-low-concentration element can be quantitatively determined at the same time, and the concentration distribution of an analytical element whose concentration varies in a wide range from a large value to a considerably small value, can be accurately determined.

DESCRIPTION OF THE PREFERRED EMBODIMENT

Figure 1:
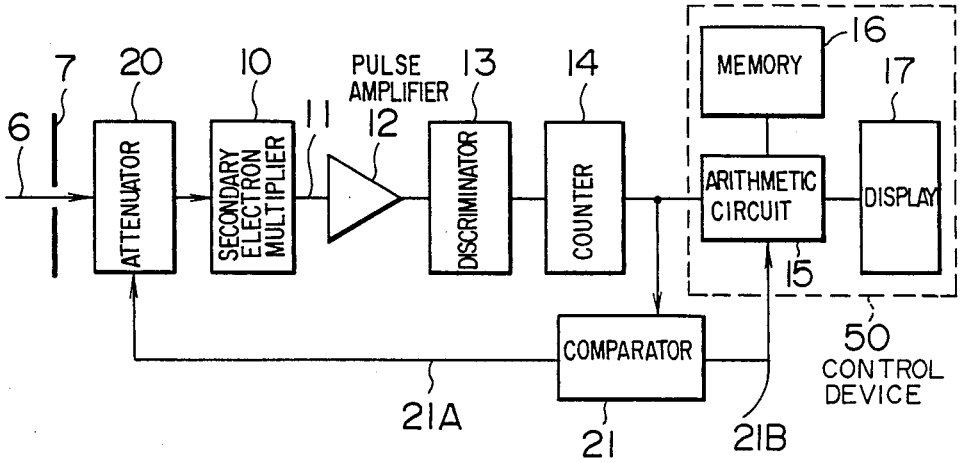
FIG. 1 is a block diagram showing a detection system of an embodiment of a secondary ion mass spectrometer according to the present invention.
Figure 2:
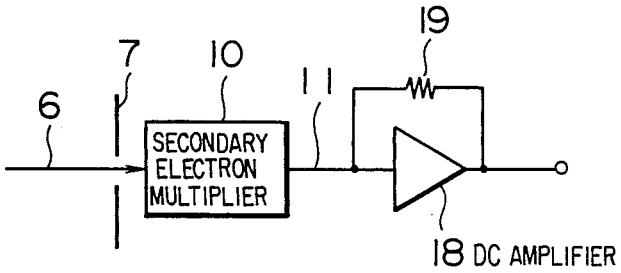
FIG. 2 PRIOR ART
FIG. 2 is a block diagram which shows a conventional detection system for detecting a secondary ion by the DC amplification method.
Figure 3:
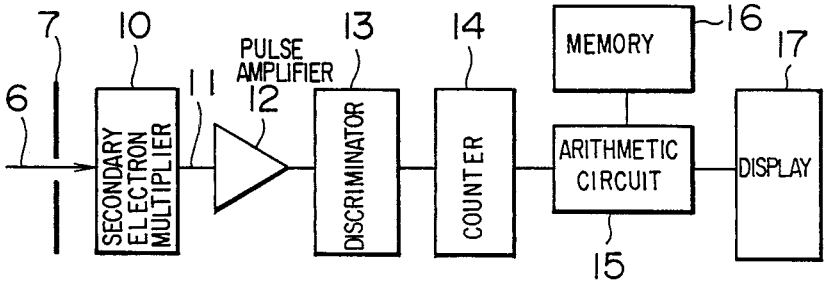
FIG. 3 PRIOR ART
FIG. 3 is a block diagram which shows another conventional detection system for detecting a secondary ion by the pulse measuring method.
Figure 4:
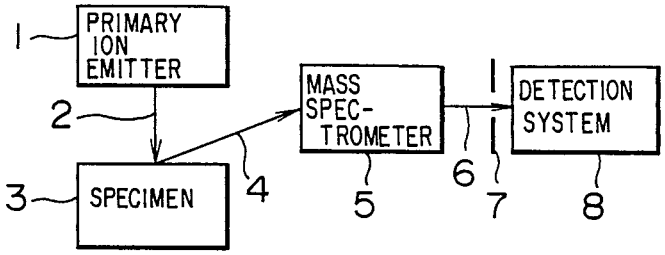
FIG. 4 is a block diagram showing the fundamental construction of a secondary ion mass spectrometer.

Now, explanation will be made of an embodiment of a secondary ion mass spectrometer according to the present invention, with reference to the drawings. FIG. 1 is a block diagram showing a detection system of the present embodiment.

Referring to FIG. 1, an attenuator 20 is disposed in the rear of a slit 7, and is connected to a secondary electron multiplier 10, which is connected to a high-speed pulse amplifier 12. The pulse amplifier 12 is connected to a discriminator 13, which is connected to a pulse counter circuit 14. The counter circuit 14 is connected to an arithmetic circuit 15, which is connected to a memory circuit 16 and an output display device 17. The output of the counter circuit 14 is applied not only to the arithmetic circuit 15 but also to a comparator 21.

Next, the operation of the above detection system will be explained. A secondary ion 6 with a desired mass passes through the slit 7, and then impinges on the secondary electron multiplier 10 through the attenuator 20. The attenuator 20 is put in a state capable of attenuating a secondary ion beam or in a state incapable of attenuating the secondary ion beam. A current 11 from the secondary electron multiplier 10 is amplified by the high-speed pulse amplifier 12. When the level of a pulse current delivered from the amplifier 12 exceeds a predetermined level, the discriminator 13 delivers a pulse. The counter circuit 14 counts such a pulse. A counted value delivered from the counter circuit 14 is applied to a control device 50 which is made up of the arithmetic circuit 15, the memory circuit 16 and the display device 17. In more detail, the counted value from the counter circuit 14 is sent through the arithmetic circuit 15 to the memory circuit 16, to be stored therein. Data stored in the memory circuit 16 is subjected to an arithmetic operation, to be displayed by the display device 17.

While, the comparator 21 checks whether or not the counted value from the counter circuit 14 exceeds a first predetermined value lying in the dynamic range of a detection part which is made up of the secondary electron multiplier 10, pulse amplifier 12, discriminator 13 and pulse counter 14. When the counted value exceeds the first predetermined value, the comparator 21 sends a signal 21A to the attenuator 20, to operate the attenuator 20. Simultaneously with the above operation, the comparator 21 sends a signal 21B to the arithmetic circuit 15. The arithmetic circuit 15 divides the counted value which is stored in the memory circuit 16 in a period when the signal 21B is sent out from the comparator 21, by the attenuation factor of the attenuator 20, to deliver a corrected value to the display device 16. Further, when the counted value from the counter circuit 14 becomes smaller than a second predetermined value in a period, during which the attenuator 20 is operated, the comparator 21 cuts off the signals 21A and 21B, to stop the operation of the attenuator 20.

Next, explanation will be made of examples of the actual construction of the attenuator 20.

Figure 5A:
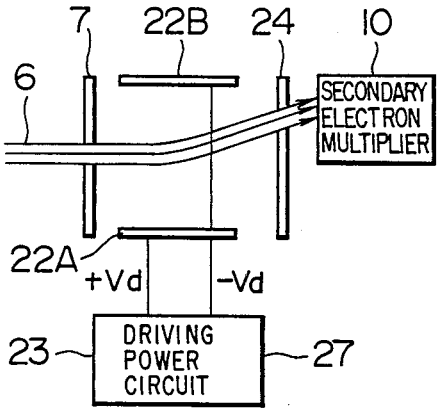
FIGS. 5A and 5B are block diagrams showing an attenuator of the electrostatic deflection type.

FIG. 5A shows an example of the attenuator 20. As shown in FIG. 5A, the present example is made up of an electrostatic deflector 27 and an aperture plate 24, and the deflector 27 includes parallel electrodes 22A and 22B and a driving power circuit 23. Output voltages $+V_d$ and $-V_d$ from the driving power circuit 23 are applied to the electrodes 22A and 22B, respectively.

Figure 5B:
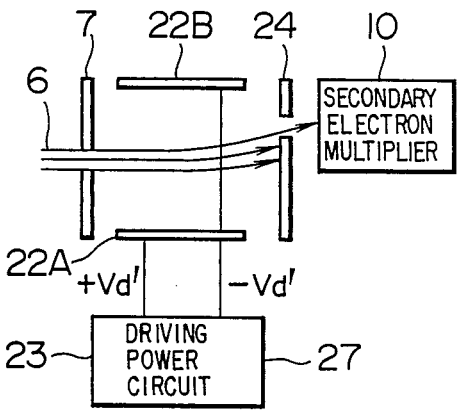
Figure 6:
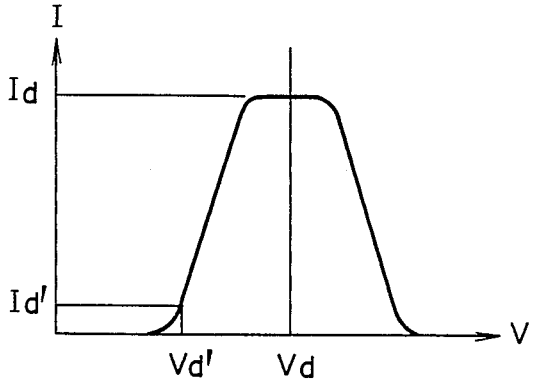
FIG. 6 is a graph showing a V-I characteristic of the attenuator of FIGS. 5A and 5B.

A secondary ion beam formed of secondary ions 6 having the same mass is deflected by an electrostatic field established between the electrodes 22A and 22B, and then impinges on the secondary electron multiplier 10 through the aperture of the aperture plate 24. When the signal 21A is applied to the attenuator 20, the driving power circuit 23 generates output voltages $+V_d'$ and $-V_d'$ which are smaller in absolute value than the voltages $+V_d$ and $-V_d$, as shown in FIG. 5B. FIG. 6 is a graph showing a relationship between the absolute value V of the output voltages of the driving power circuit 23 and the ion current I passing through the aperture. That is, the ion current passing through the aperture has a V-I characteristic shown in FIG. 6, and reaches a maximum value $I_d$ when the absolute value of the output voltages is equal to $V_d$. When the absolute value of the output voltages is made equal to $V_d'$ as shown in FIG. 5B, the ion current is reduced to a value $I_d'$.

Figure 7:
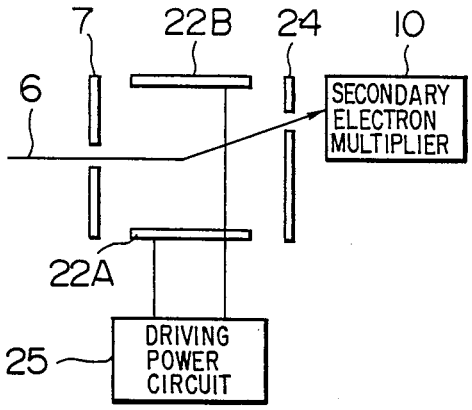
FIG. 7 is a block diagram showing an attenuator of the AC deflection type.

FIG. 7 is a block diagram showing another example of the attenuator 20. When the signal 21A is applied to the attenuator 20, a driving power circuit 25 superposes an AC voltage $V_{AC}$ on a DC output voltage $-V$, as shown in FIG. 7. Accordingly, the aperture plate 24 is scanned with the secondary ion beam having passed through the slit 7, and thus the secondary ion current flowing through the aperture of the aperture plate 24 is reduced. A reduction in secondary ion current is proportional to the length of the scanning line which is formed on the aperture plate 24 by the secondary ion beam.

Figure 8:
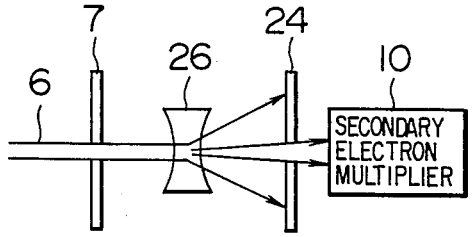
FIG. 8 is a block diagram showing an attenuator of the electrostatic lens type.

FIG. 8 is a block diagram showing a further example of the attenuator 20. The present example uses an electrostatic lens 26. As shown in FIG. 8, the electrostatic lens 26 is disposed between the slit 7 and the aperture plate 24, and is operated so that an input beam is converted into a divergent beam. Thus, the current density of the secondary ion current emerging from the electrostatic lens 26 is weakened, and hence the secondary ion current flowing through the aperture of the aperture plate 24 is reduced. The electrostatic lens 26 may be replaced by an electromagnetic lens.

In the examples shown in FIGS. 5A, 5B, 7 and 8, an attenuation factor of $10^{-1}$ to $10^{-4}$ can be obtained. Accordingly, the detection system will be able to have a dynamic range, in which the amount of secondary ion varies by eight to ten orders of magnitude.

Figure 9A:
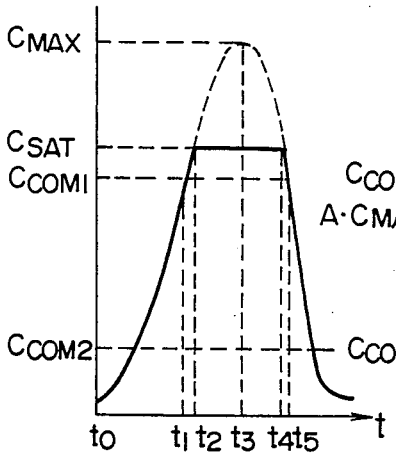
FIGS. 9A to 9C are graphs for explaining an example of the quantitative analysis using the detection system of FIG. 1.
Figure 9B:
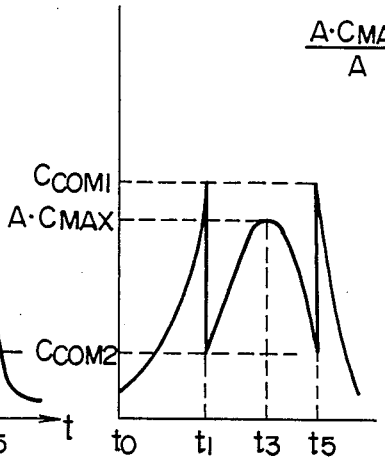
Figure 9C:
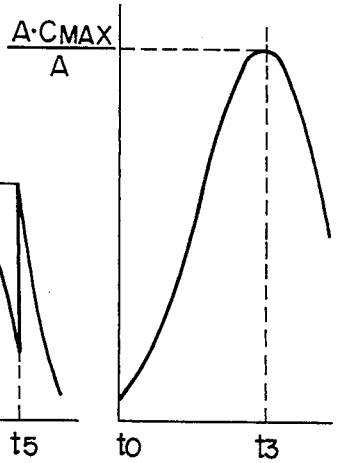

Next, explanation will be made of an example of the quantitative analysis using the detection system of FIG. 1. FIGS. 9A to 9C are graphs for explaining the quantitative determination of an analytical element along the direction of the thickness of a specimen for a case where the concentration of the analytical element varies in a wide range from a minimum value $C_{min}$ to a maximum value $C_{max}$. FIG. 9A shows the concentration distribution obtained by using a conventional detection system. In this case, a distribution curve showing a saturation value $C_{sat}$ is obtained as indicated by a solid line in FIG. 9A. In other words, the saturation value $C_{sat}$ is the upper limit of the dynamic range of the conventional detection system corresponding to the detection part of the present embodiment, and hence concentration values between the saturation value $C_{sat}$ and the maximum value $C_{max}$ cannot be detected.

FIG. 9B shows the concentration distribution obtained on the basis of the output of the counter circuit 14 of the detection system of FIG. 1. In this case, a first concentration level $C_{com1}$ and a second concentration level $C_{com2}$ are set in the comparator 21 so that the first and second levels $C_{com1}$ and $C_{com2}$ lie in the dynamic range of the detection part which includes the secondary electron multiplier 10, pulse amplifier 12, discriminator 13 and counter circuit 14, and the first level $C_{com1}$ is higher than the second level $C_{com2}$. When it is judged by the comparator 21 that the output of the counter circuit 14 becomes higher than the first level $C_{com1}$ immediately before a time $t_1$, the product of the first level $C_{com1}$ and an attenuation factor A of the attenuator 20 is delivered from the counter circuit 14 at the time t1 and the product of the maximum value $C_{max}$ and the attenuation factor A is delivered from the counter circuit 14 at a time $t_3$, as shown in FIG. 9B. When the output of the counter circuit 14 becomes lower than the second level $C_{com2}$ at a time $t_5$, the comparator 21 cuts off the signal 21A, and thus the operation of the attenuator 20 is stopped. Hence, the output of the counter circuit 4 obtained in a period from $t_1$ to $t_5$ (namely, a period when the attenuator 20 is operated), is divided by the attenuation factor A, to obtain corrected data. FIG. 9C shows the concentration distribution based upon the corrected data. As can be seen from FIGS. 9B and 9C, the actual concentration value is faithfully reflected in the output of the counter circuit 14. That is, according to the present embodiment, an analytical element can be quantitatively determined in a wide concentration range. Hence, it is not required to select an analytical element which produces an appropriate ion current, and thus the operability of a secondary ion mass spectrometer is greatly improved. Accordingly, various specimens containing one or more analytical elements can be analyzed by a single analytical operation.

As has been explained in the foregoing, in a secondary ion mass spectrometer according to the present invention, a desired secondary ion current which starts from a specimen and has passed through a mass spectrometer, is attenuated, to reduce the amount of detected secondary ion, and a value indicative of the amount of detected secondary ion is divided by an attenuation factor to obtain a corrected value, which is displayed by a display device. Hence, the dynamic range of the detection system can be greatly enlarged. As a result, a high-concentration element and a considerably-low-concentration element can be quantitatively determined at the same time, and the concentration distributing of an analytical element in a specimen can be measured in a wide concentration range from a large value to a considerably small value.

We claim:

1. A secondary ion mass spectrometer comprising:

primary ion emitting means for generating a primary ion beam to irradiate a specimen with the primary ions;

means for separating secondary ions in accordance with mass-to-charge ratios, the secondary ions being sputtered from the specimen on the basis of the bombardment of the specimen with the primary ions;

detection means for detecting a secondary ion from the secondary ion separating means, in synchronism with the emission of the primary ions from the primary ion emitting means;

a slit disposed between the secondary ion separating means and the detection means;

a comparator for checking whether or not the value of secondary ion current detected by the detection means is greater than a predetermined value lying in a dynamic range of the detection means;

an attenuator disposed in the rear of the slit for attenuating a secondary ion current having passed through the slit, when the value of secondary ion current detected by the detection means is greater than the predetermined value;

a driving power circuit applied with a signal from the comparator when it is judged by the comparator that the value of secondary ion current detected by the detection means is greater than the predetermined value, to operate the attenuator; and a control unit for dividing the value of secondary ion current detected by the detection means in a period when the attenuator is operated, by an attenuation factor of the attenuator to obtain a corrected value of secondary ion current.

2. A secondary ion mass spectrometer according to claim 1, wherein the attenuator is made up of an electrostatic deflector and an aperture, and the amount of secondary ion passing through the aperture is reduced by varying the strength of an electrostatic field formed in the electrostatic deflector.

3. A secondary ion mass spectrometer according to claim 2, wherein the electrostatic deflector is made up of a pair of parallel electrodes and the driving power circuit.

4. A secondary ion mass spectrometer according to claim 1, wherein the attenuator is made up of an electrostatic deflector and an aperture, and a high-frequency voltage is applied to the electrostatic deflector to scan the aperture with a secondary ion beam, thereby reducing the amount of secondary ion-passing through the aperture.

5. A secondary ion mass spectrometer according to claim 1, wherein the attenuator is made up of an electrostatic lens and an aperture, and the electrostatic lens is operated so that an input beam thereto is converted into a divergent beam, to reduce the current density of the secondary ion current passing through the aperture.

6. A secondary ion mass spectrometer according to claim 1, wherein the detection means includes a secondary electron multiplier, a high-speed pulse amplifier, a discriminator, and a pulse counter circuit.

* * * * *